US011210986B1

(12) United States Patent
Kuei et al.

(10) Patent No.: US 11,210,986 B1
(45) Date of Patent: Dec. 28, 2021

(54) DISPLAY DRIVING APPARATUS AND METHOD

(71) Applicant: Novatek Microelectronics Corp., Hsinchu (TW)

(72) Inventors: Cheng-Kai Kuei, Hsinchu (TW); Chin-Hung Hsu, Taoyuan (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 16/984,137

(22) Filed: Aug. 3, 2020

(51) Int. Cl.
*G09G 3/20* (2006.01)

(52) U.S. Cl.
CPC ..... *G09G 3/20* (2013.01); *G09G 2310/027* (2013.01); *G09G 2310/0286* (2013.01); *G09G 2310/0289* (2013.01); *G09G 2310/0291* (2013.01); *G09G 2330/021* (2013.01)

(58) Field of Classification Search
CPC ..... G09G 3/20; G09G 3/2085; G09G 5/39; G09G 2310/024; G09G 2310/027; G09G 2310/04; G09G 2310/061; G09G 2320/0252; G09G 2330/021; G09G 2340/16; G09G 2360/12; G09G 3/3208; G09G 3/342; G09G 3/3648; G02F 1/136213
See application file for complete search history.

(56) References Cited

U.S. PATENT DOCUMENTS

2001/0030645 A1* 10/2001 Tsutsui ..... G09G 3/3696 345/211
2008/0170028 A1* 7/2008 Yoshida ..... G09G 3/20 345/100
2019/0333465 A1* 10/2019 Im ..... G09G 3/3611

* cited by examiner

*Primary Examiner* — Nelson M Rosario
(74) *Attorney, Agent, or Firm* — JCIPRNET

(57) ABSTRACT

A display driving apparatus with a power control circuit reducing power consumption includes: a shift register receiving a display data signal and outputting a plurality of data signals; a first latch receiving a Nth data signal of the plurality of data signals and outputting a first latched data signal according to a first gate driving signal; an analog signal processing circuit including a second latch coupling to the first latch and outputting a second latched data signal according to a second gate driving signal; a data comparator comparing the first latched data signal and the second latched data signal; and a power controller coupling to the data comparator and controlling a power level of the analog signal processing circuit.

17 Claims, 5 Drawing Sheets

100

DISPLAY DRIVING APPARATUS AND METHOD

BACKGROUND

Technical Field

The disclosure relates to a display driving apparatus and a display driving method.

Description of Related Art

Generally, a pixel element (i.e. liquid crystal or light-emitting diode) of a display panel is charged/discharged by a source driver to form a pixel voltage for displaying according to display data signals received by the source driver. The source driver charges/discharges each channel of the display panel according to a plurality of gate driving signals corresponding to each channel of the display panel. Take a signal timing diagram of a source driving signal (Y[n]) and gate driving signals (G[m], G[m+1]) in FIG. 5 as an example, the source driver outputs the source driving signal (Y[n], solid line), and the source driving signal (Y[n]) is transmitted to the mth channel of the display panel according to a falling edge of the gate driving signal (G[m]) and transmitted to the (m+1)th channel of the display panel according to a falling edge of the gate driving signal (G[m+1]).

Since the source driving signal (Y[n]) is transmitted to each channel of the display panel according to a corresponding falling edge of the gate driving signals, the voltage of the source driving signal (Y[n]) is charged/discharged to a voltage level according to the display data signals before the corresponding falling edge of the gate driving signals. A part of the source driver for generating the source driving signal (Y[n]) may be set to power-off in the time intervals from A to A' or from B to B' to reduce power consumption.

Nothing herein should be construed as an admission of knowledge in the prior art of any portion of the present disclosure.

SUMMARY

A display driving apparatus and method with a part of the source driver set to power-off in time intervals to generate the source driving signal to each channel of the display panel is introduced. In addition, power-off time intervals of the part of the source driver are set according to the display data signals received by the source driver.

In an embodiment of the disclosure, the display driving apparatus includes a shift register receiving a display data signal and outputting a plurality of data signals; a first latch receiving a Nth data signal of the plurality of data signals and outputting a first latched data signal according to a first gate driving signal; an analog signal processing circuit including a second latch coupling to the first latch and outputting a second latched data signal according to a second gate driving signal; a data comparator comparing the first latched data signal and the second latched data signal; and a power controller coupling to the data comparator and controlling a power level of the analog signal processing circuit.

In an embodiment of the disclosure, the display driving method includes receiving a display data signal and outputting a plurality of data signals; receiving a Nth data signal of the plurality of data signals, wherein N is a positive integer; outputting a first latched data signal according to a first gate driving signal; outputting a second latched data signal according to a second gate driving signal; comparing the first latched data signal and the second latched data signal; controlling a power level of a source driving signal; and outputting the source driving signal.

To sum up, the display driving apparatus and method provided by the disclosure reduce power consumption by setting the part of the source driver to power-off in time intervals according to the display data signals received by the source driver to generate the source driving signal to each channel of the display panel.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Embodiments of the disclosure are described hereinafter with reference to the drawings.

Figure 1:
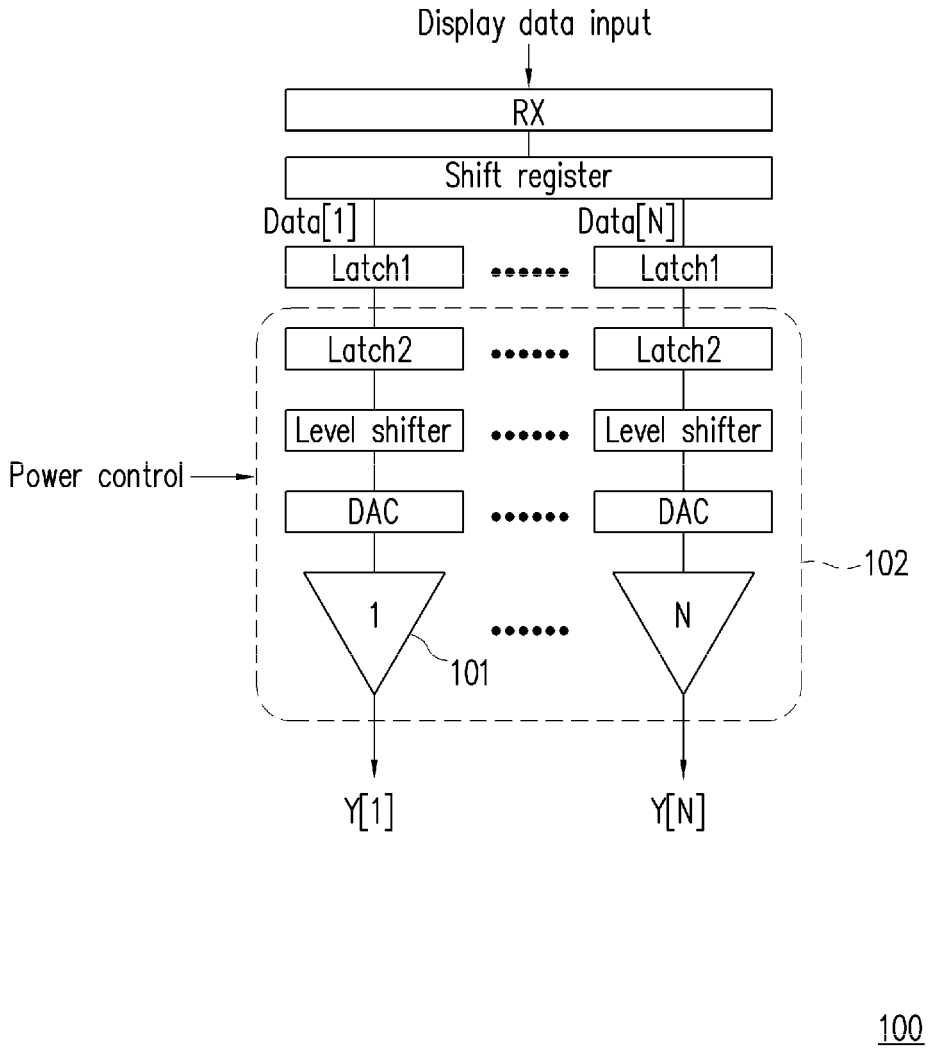
FIG. 1 is a schematic diagram of a display driving apparatus 100 according to an embodiment of the disclosure.

FIG. 1 is a schematic diagram of a display driving apparatus 100 according to an embodiment of the disclosure. The display driving apparatus 100 includes a receiver RX, a shift register, a plurality of first latches (Latch 1), and analog signal processing circuit 102, and a power control circuit (not shown in FIG. 1). The analog signal processing circuit 102 includes a plurality of second latches (Latch 2), level shifters, digital to analog converters (DAC), and output buffers 101. The receiver RX receives display data signals. The shift register serially receives data signals from the receiver RX and parallel outputs data signals Data[1], Data[2], . . . Data[N] to the plurality of first latches (Latch 1). The analog signal processing circuit 102 couples to the plurality of first latches (Latch 1) and outputs source driving signals Y[1], Y[2], . . . Y[N] to each channel of the display panel, and voltage levels of the source driving signals Y[1], Y[2], . . . Y[N] are set by the analog signal processing circuit 102 according to the data signals Data[1], Data[2], . . . Data[N] respectively, wherein the data signals Data[1], Data[2], . . . Data[N] include grayscale values. The power control circuit controls power-off time intervals of a part of the analog signal processing circuit 102 according to the data signals Data[1], Data[2], . . . Data[N].

Figure 2:
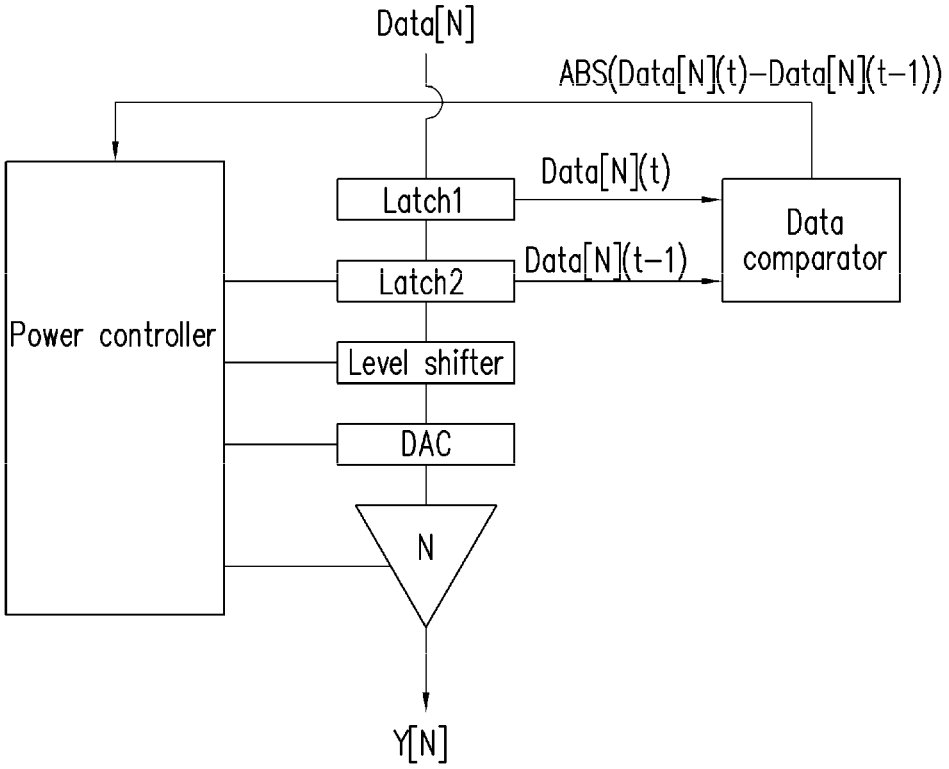
FIG. 2 is a schematic diagram of the display driving apparatus 100 according to an embodiment of the disclosure.

FIG. 2 is a schematic diagram of the display driving apparatus 100 according to an embodiment of the disclosure. As shown in FIG. 1 and FIG. 2, a nth branch of the analog signal processing circuit 102 couples to the Latch 1 receiving the data signal Data[N] and outputs the source driving signal Y[N] to each channel of the display panel. The Latch 1 receives the data signal Data[N] and outputs a first latched data signal Data[N](t) to a data comparator according to a first gate driving signal. The Latch 2 couples to the Latch 1 and outputs a second latched data signal Data[N](t−1) to the data comparator according to a second gate driving signal, wherein adjacent channels of the display panel are controlled by the first gate driving signal and the second gate driving signal.

The data comparator compares the first latched data signal Data[N](t) and the second latched data signal Data[N](t−1) and outputs a comparing result ABS(Data[N](t)-Data[N](t−1)) including an absolute value of a difference between the first latched data signal and the second latched data signal to a power controller. The power controller controls the power-off time intervals of the part of the analog signal processing circuit 102 (ex: level shifter, DAC and output buffer) according to the comparing result.

Figure 3:
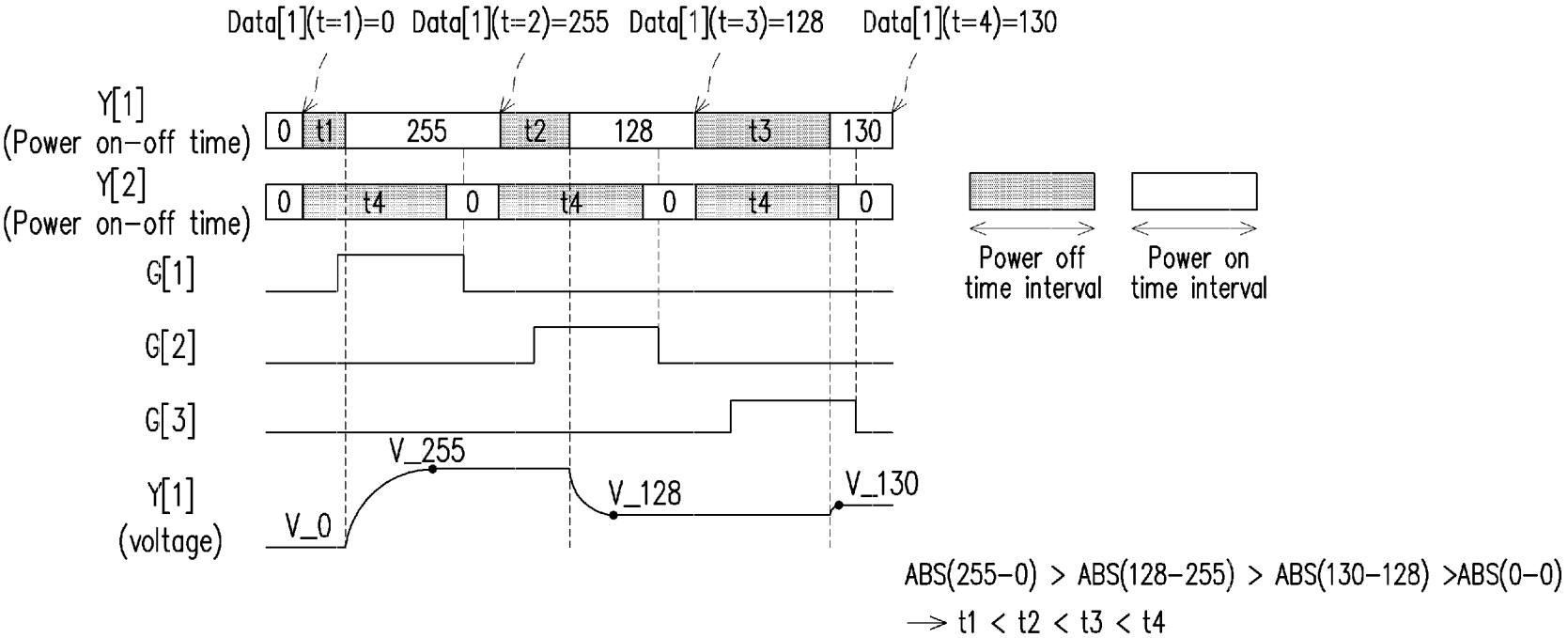
FIG. 3 is a signal timing diagram of the display driving apparatus 100 according to an embodiment of the disclosure.

FIG. 3 is a signal timing diagram of the display driving apparatus 100 according to an embodiment of the disclosure. FIG. 3 shows a power on-off timing diagram of the 1st branch of the analog signal processing circuit 102 generating the source driving signal Y[1] and 2nd branch of the analog signal processing circuit 102 generating the source driving signal Y[2]. Data signal Data[1] is latched as Data[1](t=1) equal to grayscale value 0 by the Latch 2 according to a gate driving signal G[0] (not shown in FIG. 3), data signal Data[1] is latched as Data[1](t=2) equal to grayscale value 255 by the Latch 1 according to a gate driving signal G[1], the data comparator compares Data[1](t=1) and Data[1](t=2) and outputs a comparing result ABS(255-0) equal to 255 to the power controller. The power controller controls the power-off time interval of the part of the analog signal processing circuit 102 to t1 according to the comparing result ABS(255-0) in a cycle period corresponding to the gate driving signal G[1]. The analog signal processing circuit 102 sets voltage levels of the source driving signals Y[1] from V_0 to V_255 in the cycle period corresponding to the gate driving signal G[1] when the power controller sets the part of the analog signal processing circuit 102 from power-off time interval t1 to power-on time interval.

In next cycle period corresponding to a gate driving signal G[2], data signal Data[1] is latched as Data[1](t=2) equal to grayscale value 255 by the Latch 2 according to the gate driving signal G[1], data signal Data[1] is latched as Data[1](t=3) equal to grayscale value 128 by the Latch 1 according to the gate driving signal G[2], the data comparator compares Data[1](t=2) and Data[1](t=3) and outputs a comparing result ABS(128-255) equal to 127 to the power controller. The power controller controls the power-off time interval of the part of the analog signal processing circuit 102 to t2 according to the comparing result ABS(128-255) in the cycle period corresponding to the gate driving signal G[2]. The analog signal processing circuit 102 sets voltage levels of the source driving signals Y[1] from V_255 to V_128 in the cycle period corresponding to the gate driving signal G[2] when the power controller sets the part of the analog signal processing circuit 102 from power-off time interval t2 to power-on time interval.

In next cycle period corresponding to a gate driving signal G[3], data signal Data[1] is latched as Data[1](t=3) equal to grayscale value 128 by the Latch 2 according to the gate driving signal G[2], data signal Data[1] is latched as Data[1](t=4) equal to grayscale value 130 by the Latch 1 according to the gate driving signal G[3], the data comparator compares Data[1](t=3) and Data[1](t=4) and outputs a comparing result ABS(130-128) equal to 2 to the power controller. The power controller controls the power-off time interval of the part of the analog signal processing circuit 102 to t3 according to the comparing result ABS(130-128) in the cycle period corresponding to the gate driving signal G[3]. The analog signal processing circuit 102 sets voltage levels of the source driving signals Y[1] from V_128 to V_130 in the cycle period corresponding to the gate driving signal G[3] when the power controller sets the part of the analog signal processing circuit 102 from power-off time interval t3 to power-on time interval.

The power controller controls the power on-off time intervals of the 2nd branch of the analog signal processing circuit 102 generating the source driving signal Y[2] same with the control of the power on-off time intervals of the 1st branch of the analog signal processing circuit 102 generating the source driving signal Y[1]. The power off time intervals of each branch of the analog signal processing circuit 102 may be set inversely proportional to the comparing result (i.e. t1<t2<t3<t4) by the power controller since the larger the data signal Data[N] latched by the Latch 1 and the Latch 2 change (i.e. ABS(255-0)>ABS(128-255)>ABS(130-128)>ABS(0-0)) the longer a charge/discharge time needs.

Figure 4:
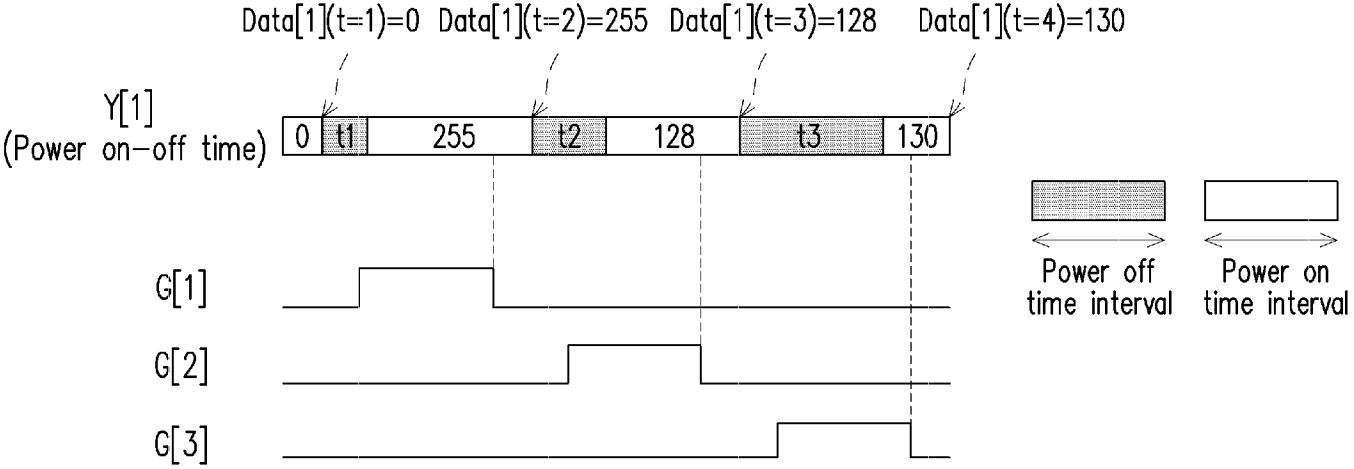
FIG. 4 is a signal timing diagram of the display driving apparatus 100 according to another embodiment of the disclosure.
Figure 5:
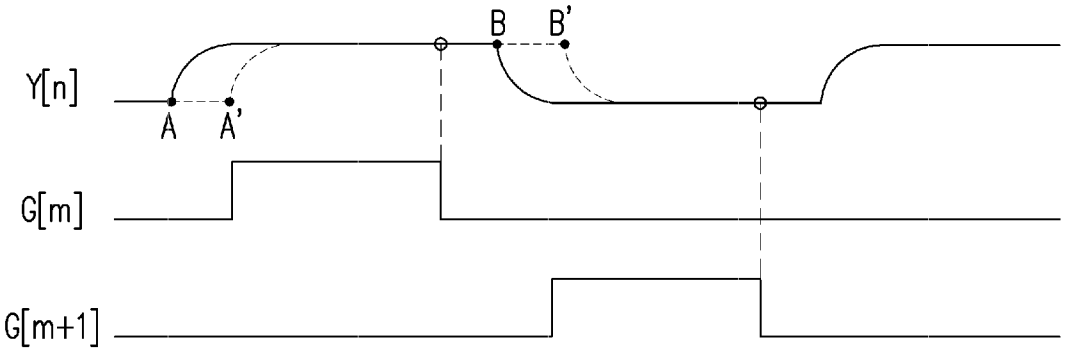
FIG. 5 is a signal timing diagram of the display driving apparatus 100 according to an embodiment of the disclosure.

FIG. 4 is a signal timing diagram of the display driving apparatus 100 according to another embodiment of the disclosure. The power off time intervals of each branch of the analog signal processing circuit 102 may be set the same by the power controller according to a maximum difference between the data signal Data[N] latched by the Latch 1 and the data signal Data[N] latched by the Latch 2 (i.e. ABS(255-0)).

From the above embodiments, the display driving apparatus 100 with the power controller controlling the power off time intervals of each branch of the analog signal processing circuit 102 according to the display data signals reduces the power consumption of the display driving apparatus 100.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A display driving apparatus adapted to drive a display panel, comprising:

a shift register, receiving a display data signal and outputting a plurality of data signals;

a first latch, receiving a Nth data signal of the plurality of data signals and outputting a first latched data signal according to a first gate driving signal, wherein N is a positive integer;

an analog signal processing circuit, comprising:

a second latch, coupling to the first latch and outputting a second latched data signal according to a second gate driving signal;

a data comparator, comparing the first latched data signal and the second latched data signal; and a power controller, coupling to the data comparator and controlling a power level of the analog signal processing circuit.

2. The display driving apparatus as claimed in claim 1, wherein adjacent channels of the display panel are controlled by the first gate driving signal and the second gate driving signal.

3. The display driving apparatus as claimed in claim 1, wherein the data comparator outputs a comparing result comprising an absolute value of a difference between the first latched data signal and the second latched data signal.

4. The display driving apparatus as claimed in claim 3, wherein the power controller controls power off time intervals of the analog signal processing circuit according to the comparing result.

5. The display driving apparatus as claimed in claim 4, wherein the power off time intervals of the analog signal processing circuit are set inversely proportional to the comparing result.

6. The display driving apparatus as claimed in claim 4, wherein the power off time intervals of the analog signal processing circuit are set the same according to a maximum difference between the first latched data signal and the second latched data signal.

7. The display driving apparatus as claimed in claim 1, wherein the plurality of data signals comprise grayscale values.

8. The display driving apparatus as claimed in claim 1, wherein the analog signal processing circuit further comprising:

a level shifter, coupling to the second latch;

a digital to analog converter, coupling to the level shifter; and a output buffer, coupling to the digital to analog converter and outputting a source driving signal.

9. The display driving apparatus as claimed in claim 8, wherein the output buffer outputs the source driving signal having a voltage level proportional to a grayscale value of the Nth data signal.

10. A display driving method adapted to drive a display panel, comprising:

receiving a display data signal and outputting a plurality of data signals;

receiving a Nth data signal of the plurality of data signals, wherein N is a positive integer;

outputting a first latched data signal according to a first gate driving signal;

outputting a second latched data signal according to a second gate driving signal;

comparing the first latched data signal and the second latched data signal;

controlling a power level of a source driving signal; and outputting the source driving signal.

11. The display driving method as claimed in claim 10, wherein adjacent channels of the display panel are controlled by the first gate driving signal and the second gate driving signal.

12. The display driving method as claimed in claim 10, wherein a comparing result comprising an absolute value of a difference between the first latched data signal and the second latched data signal is outputted.

13. The display driving method as claimed in claim 12, wherein power off time intervals of an analog signal processing circuit are controlled according to the comparing result.

14. The display driving method as claimed in claim 13, wherein the power off time intervals of the analog signal processing circuit are set inversely proportional to the comparing result.

15. The display driving method as claimed in claim 13, wherein the power off time intervals of the analog signal processing circuit are set the same according to a maximum difference between the first latched data signal and the second latched data signal.

16. The display driving method as claimed in claim 10, wherein the plurality of data signals comprise grayscale values.

17. The display driving method as claimed in claim 10, wherein the source driving signal has a voltage level proportional to a grayscale value of the Nth data signal.

* * * * *